US005375848A

United States Patent [19]

Coleman

[11] Patent Number: 5,375,848

[45] Date of Patent: Dec. 27, 1994

[54] BOLA BALL GAME

[75] Inventor: Thomas J. Coleman, Bristol, Va.

[73] Assignee: B.A.A.T. Enterprises, Inc., Bristol, Va.

[21] Appl. No.: 217,656

[22] Filed: Mar. 25, 1994

[51] Int. Cl.[5] ..... A63B 67/00

[52] U.S. Cl. ..... 273/327; 273/346; 273/428; 273/DIG. 30; 273/58 C

[58] Field of Search ..... 273/318, 327, 412, 413, 273/428, 346, 58 C, DIG. 30

[56] References Cited

U.S. PATENT DOCUMENTS

| | | | |
|---|---|---|---|
| 442,676 | 12/1890 | Wilcox | 273/327 |
| 2,120,075 | 6/1938 | Roosman | 273/327 |
| 3,049,352 | 8/1962 | Hancock | 273/327 |
| 3,425,700 | 2/1969 | Edwards | 273/58 C X |
| 3,717,348 | 2/1973 | Bowers | 273/327 |
| 4,174,834 | 11/1979 | DeMartino | 273/327 |
| 4,346,902 | 8/1982 | Warehime | 273/411 |
| 4,789,161 | 12/1988 | Waskelo | 273/327 |
| 5,123,655 | 6/1992 | Rones | 273/346 |

*Primary Examiner*—William H. Grieb
*Attorney, Agent, or Firm*—Melvin L. Crane

[57] ABSTRACT

A game in which one player throws a Bola Ball in such a manner that another player has difficulty in catching the Bola Ball. This can be achieved by placing a flexible cord of the Bola Ball in different positions on the stick. The player can then sling, fling, lob, twirl, etc. the Bola Ball at the other player depending on the position on the stick. After the other player has tried to catch the Bola Ball it's his/her turn to throw it back in any manner he/she wishes.

9 Claims, 1 Drawing Sheet

FIG.1
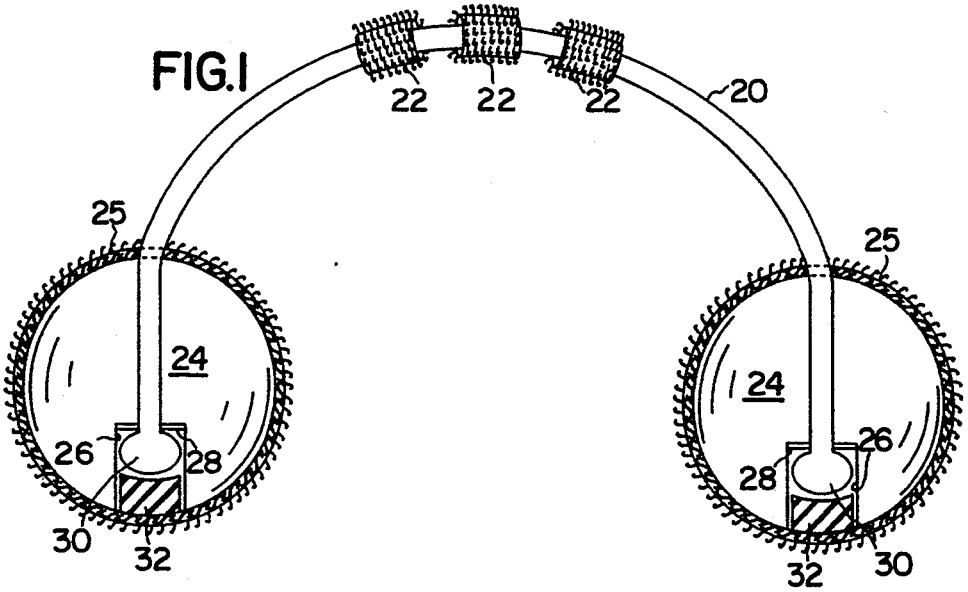
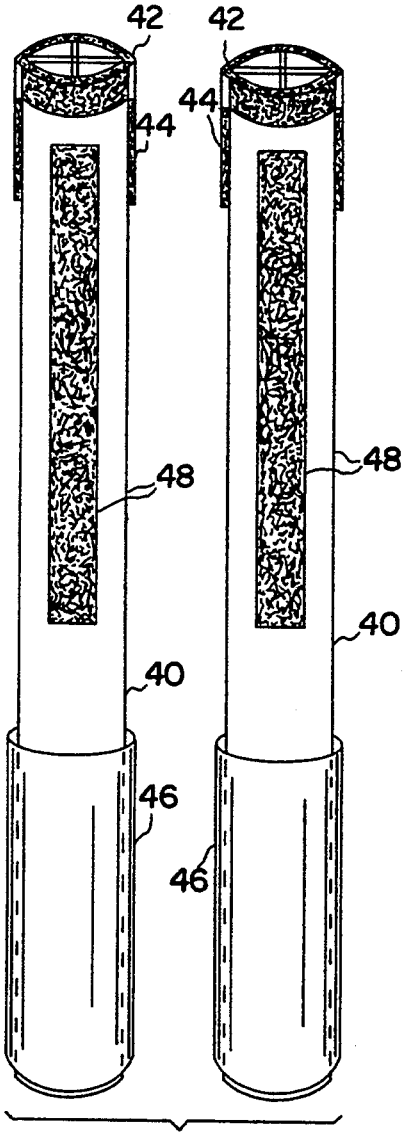
FIG.2

BOLA BALL GAME

This invention is directed to a game which includes an object to be thrown by one player which is caught by use of a special stick by another player more particularly the game includes two rubber balls with a line between the balls. The line has VELCRO between the balls wrapped around the line. The balls and the catching stick are each provided with VELCRO such that when the one player throws the ball arrangement, it is up to another player to catch the bola ball with their stick.

Heretofore games have been patented whereby one person pitches an object to another person for catching the pitched object. Such U.S. Pat. Nos. include 0,442,675; 2,120,075; 3,049,352; 3,717,348; 4,346,902; 4,174,834; and 5,123,655.

It is therefore an object to provide a game in which two or more persons can have fun by challenging each other to a game of catch with a specially arranged balls on a line cord or tubing.

Another object is to provide a game in which two persons can play a game of catch.

Another object is to provide a game that does not require a lot of skill to participate.

Yet another object is to provide a game which is inexpensive and can be played by persons of any age.

Other objects will become obvious to those skilled in the art wherein the game may be different than that set forth herein but relate to the same game.

BRIEF DESCRIPTION OF THE DRAWING

FIG. 1 illustrates two balls secured to opposite ends of a line, cord or small flexible tube illustrating VELCRO strips looped about the line cord or flexible tube; and FIG. 2 illustrates a pair of tubular plastic sticks illustrating VELCRO strips around the end of each stick; VELCRO strips along a portion of the length of each strip, with rubber grips on one end of each of the sticks.

DETAILED DESCRIPTION

The Bola Ball is designed as a throw and catch game. It consists of two (2) plastic tubular throwing sticks. Each throwing stick has foam rubber strips of hook VELCRO for catching the Bola Ball. The two (2) balls are connected with a length of flexible cord with loop VELCRO in the center for easy catching onto the stick.

FIG. 1 illustrates a line, cord or flexible small tube 20 with spaced VELCRO loop 22 for strips secured onto the line. As set forth herein the term line "refers to a line, a cord or a flexible tubing or any such similar length of material. The line has a length of about sixteen (16) inches with a diameter of about ¼ inch and is provided with a solid rubber ball 24 on each end and having a diameter of about 2½ inches. Each ball is covered with a layer of VELCRO 25. VELCRO is a synthetic material including hooks and barbs which adhere when pressed together. The line is secured to each ball by passing the opposite ends along a diameter of each ball to extend substantially to the opposite side of the ball. The end of the line secured in a counter sunk hole 26 by slipping a washer 28 over the end of the line and anchoring the end of the line by a knott 30 or by any other means. A rubber plug 32 can be inserted back into the ball to fill the hole with a rubber insert. If one is careful in forming the counter sunk hole in the balls, the rubber removed could be used to refill the counter sunk hole.

The loops 22 on the line may be formed with relative tight fitting loops of VELCRO which can be adjusted along the length of the line between the balls in order to change the pitching and catching of the bola ball. The VELCRO will be on the outside surface of the loops.

The two sticks 40 shown in FIG. 2 are identical. The sticks are made of a fluorescent, light weight, plastic material having a length of about 13 inches with a diameter of about one (1) inch. Each of the sticks are provided with an end cap 42 which prevents any foreign objects from entering the end of the sticks. From the end caps there is provided about two (2) inches of VELCRO strips 44 which extend downwardly along the opposite end of the sticks which is provided with a foam rubber grip 46 similar to a bicycle handle grip. Additional VELCRO strips 48 having a length of about five (5) inches extends along the length of the stick from between the upper end VELCRO strips 44 with a spacing between the lower ends of the VELCRO strips and the hand grips. The hand grips enclose the end of the stick.

In carrying out the game the player throws the Bola Ball in such a manner that another player has difficulty in catching the Bola Ball. This can be achieved by placing the flexible cord of the Bola Ball in different positions on the stick. The player can then sling, fling, lob, twirl, etc. the Bola Ball at the other player depending on the position of the Bola Ball. After the other player has tried to catch the Bola Ball it's his/her turn to throw it back to another player in any manner he/she wishes.

The dimensions set forth herein are illustrative and may be changed to different lengths and sizes without departing from the invention.

It has been determined that the balls on the ends of the tube do not have to be solid nor hard, nor do they require a VELCRO covering. In order to make catching the bola ball more complicated, it is made without VELCRO, therefore the bola ball must be caught by use of the VELCRO parts along the tubing. Especially for children or those who are not so agile the ball should be soft so that there is less likelihood of injury in trying to catch the bola ball.

What is claimed is:

1. A game which can be played by two or more persons in which said game includes an elongated hand held stick for each participant, said hand held stick includes strips of VELCRO along the length beginning near an end which is not held in a participants hand, a projectile which is thrown by one participant to another participant, said projectile includes a line having a ball on each end of said line with VELCRO covering each ball, at least one VELCRO covering on said line between said ball on each end of said line, whereby the projectile is secured to the VELCRO on a participants stick and slung, flung, lobbed or twirled toward another participant who is supposed to catch the projectile on their stick by one of said balls or said at least one VELCRO covering on said line adhering to the stick of the another participant.

2. A game as set forth in claim 1; wherein said line has a plurality of VELCRO loops on the line between each said ball on each end of said line.

3. A game as set forth in claim 2; wherein each of said sticks includes a hand grip on one end.

4. A game as set forth in claim 3; in which each end of said line extends substantially through said ball along a diameter thereof and is secured with a plugged hole in each said ball.

5. A game as set forth in claim 2; in which each end of said line extends substantially through said ball along a diameter thereof and is secured with a plugged hole in each said ball.

6. A game as set forth in claim 2; in which said plurality of VELCRO loops on said line are secured onto said line tightly enough to prevent self movement so that each of said loops can be moved by a participant in a desired position on the line for throwing the bola ball to another participant.

7. A game as set forth in claim 1; wherein each of said sticks includes a hand grip on one end.

8. A game as set forth in claim 7; in which each end of said line extends substantially through said ball along a diameter thereof and is secured with a plugged hole in each said ball.

9. A game as set forth in claim 1; in which each end of said line extends substantially through said ball along a diameter thereof and is secured with a plugged hole in each said ball.

* * * * *